US006726036B2

(12) United States Patent
Koellner

(10) Patent No.: US 6,726,036 B2
(45) Date of Patent: Apr. 27, 2004

(54) HANGING APPARATUS FOR HANGING LAUNDRY AND THE LIKE

(75) Inventor: Hans-Joachim Koellner, Duesseldorf (DE)

(73) Assignee: Wenko-Wenselaar GmbH & Co. KG, Hilden (DE)

( * ) Notice: Subject to any disclaimer, the term of this patent is extended or adjusted under 35 U.S.C. 154(b) by 9 days.

(21) Appl. No.: 10/139,754

(22) Filed: May 7, 2002

(65) Prior Publication Data

US 2002/0166829 A1 Nov. 14, 2002

(30) Foreign Application Priority Data

May 7, 2001 (DE) ..... 201 07 694 U

(51) Int. Cl.[7] ..... A47F 5/00
(52) U.S. Cl. ..... 211/104; 211/99; 211/172
(58) Field of Search ..... 211/104, 99, 100, 211/170, 172, 175, 1.3

(56) References Cited

U.S. PATENT DOCUMENTS

| | | | | |
|---|---|---|---|---|
| 977,921 | A | | 12/1910 | Zizinia |
| 1,596,346 | A | | 8/1926 | Gibson |
| 1,654,341 | A | * | 12/1927 | Mendiolagiotia |
| 1,667,657 | A | * | 4/1928 | Dobert |
| 1,892,687 | A | * | 1/1933 | Teufel |
| 1,896,654 | A | | 2/1933 | Weaton |
| 2,379,975 | A | | 7/1945 | Luger |
| 2,492,325 | A | | 12/1949 | Schroeder |
| 2,518,370 | A | | 8/1950 | Pincus et al. |
| 2,633,989 | A | | 4/1953 | Kelly et al. |
| 4,051,953 | A | | 10/1977 | Shoaf |
| D391,719 | S | * | 3/1998 | Anderson |

FOREIGN PATENT DOCUMENTS

| | | |
|---|---|---|
| DE | 814642 | 7/1949 |
| DE | 830831 | 7/1949 |
| DE | 2932354 | 8/1979 |
| DE | 2149658 | 2/1981 |
| DE | G 8902788.4 | 3/1989 |
| DE | 29606545 | 2/1997 |
| DE | 19613449 | 10/1997 |
| EP | 808595 A1 | 5/1997 |

* cited by examiner

*Primary Examiner*—Robert W. Gibson, Jr.
(74) *Attorney, Agent, or Firm*—Crowell & Moring LLP

(57) ABSTRACT

The invention relates to a hanging device (2), in particular for drying laundry articles or the like and/or for placing, in particular attaching and hanging, objects, including at least one holding device and at least one receiving element for receiving laundry articles or the like, or other objects. Each holding device including at least one base member (4) and one swivel element (6) which is movable against and preferably capable of being connected to the base member.

9 Claims, 6 Drawing Sheets

HANGING APPARATUS FOR HANGING LAUNDRY AND THE LIKE

BACKGROUND OF THE INVENTION

The invention relates to a hanging device, in particular for drying laundry articles or the like and/or for placing, in particular attaching and hanging, objects, comprising at least one holding device and at least one receiving element for receiving laundry articles or the like, or other objects.

Numerous hanging devices are known from the prior art. For example, collapsible stands for drying laundry articles are known which can be set up in a room as needed. Such collapsible laundry stands take up considerable space in the set-up state.

In addition, numerous clothes racks are known which likewise take up much unused space when not in use.

SUMMARY OF THE INVENTION

The object of the invention is to avoid the aforementioned disadvantages.

The object is achieved by the fact that each holding device comprises at least one base member and one swivel element which is movable against and preferably capable of being connected to the base member.

The base member is provided for mounting the hanging device. The swivel element, which is arranged in such a way that it can be retracted or folded up against the base member and may be extended or swiveled out when needed, with the result that the hanging device according to the invention takes up relatively little space in the unused state, i.e., in the folded or swiveled-in state.

Connecting the swivel element to the base member simplifies the handling of the hanging device according to the invention, since the swivel element only needs to be swiveled out to use the hanging device, without first having to be assembled with the base member.

One embodiment of the invention provides that the base member and the swivel element are connected by a tongue and groove connection. Such a connection has the advantage that the swivel element may be pivoted without difficulty, and also that a hanging device according to the invention may be produced relatively economically. In addition, setting up a hanging device according to the invention with such a connection does not place high demands on the user of such a hanging device.

According to a preferred embodiment of the invention, the base member has a recess and the swivel element has an attached projection or the like which engages in the recess of the base member, with the projection attached to the swivel element preferably having a T-shape and engaging in a corresponding recess in the base member, or with the projection attached to the swivel element preferably having a shape that is at least partially cylindrical and engaging in a corresponding recess in the base member, or with the projection attached to the swivel element preferably having a shape that is at least partially spherical and engaging in a corresponding recess in the base member.

The shape of the recess in the base member is advantageously matched to the outer shape of the projection on the swivel element, so that the projection attached to the swivel element may be inserted into the recess in the base member without difficulty, and a secure attachment of the swivel element to the base member is assured.

According to the invention it is also possible for the base member to have an attached projection or the like, and for a corresponding recess to be provided in the swivel element.

The projection attached to the swivel element may have various configurations. The geometric design of the projection should be selected depending on the design of the swivel element and the base member, and on the intended purpose of the hanging device according to the invention.

The invention is not limited to the geometric designs named. Rather, all designs are possible for which the swivel element and the base member may be connected to one another while also allowing the swivel element to pivot with respect to the base member.

One advantageous embodiment provides that the base member has at least one support element or support surface or the like for supporting the swivel element in the ready-to-use state of the swivel element. The ready-to-use state is understood to mean that the swivel element is swung out. It should be understood, however, that laundry articles or the like could be hung on the hanging device when the swivel element is not swung out. The swivel element in the ready-to-use state is thus supported by the base member in such a way that no demands with respect to supporting the swivel element are placed on the connection between the base member and the swivel element. This significantly simplifies the construction and production of this connection. Even when the hanging device is loaded with relatively heavy objects, there is no need to be concerned about damaging the hanging device, since the weight of the objects acting on the swivel element is supported by the swivel element resting on the base member.

One embodiment of the invention provides that the base member has an essentially U-shaped design, with one arm of the U-shaped base member preferably interacting with the swivel element, and the other arm of the U-shaped base member supporting the swivel element in its swiveled-out state. A base member having a U shape is relatively simple to produce. A further advantage of this embodiment is realized when both arms of the U have different lengths, and, for example, the longer arm of the U-shaped base member has a recess for engaging with a projection from the swivel element. The swivel element may then be arranged in such a way that in the swiveled-out state, i.e., in the ready-to-use state, it lies on the shorter arm of the U-shaped base member and is supported by the shorter arm.

However, the invention is not limited to a base member having a U shape. For example, the base member may have a design that is at least approximately V-shaped, or having any other desired shape.

In the hanging device according to the invention, the swivel element may form the receiving element for receiving laundry articles or the like, or other objects.

It is advantageous in the handling and setting up of a hanging device according to the invention if the swivel element comprises at least two preferably parallel side pieces between which the receiving element(s) is/are suspended or supported, with each receiving element preferably comprising at least one rod and/or at least one cord or the like. It is particularly preferred for each rod to be constructed as a telescoping rod comprising a hollow outer tube and a hollow inner tube of slightly smaller diameter received in the hollow outer tube.

The invention is not limited to two side pieces. Furthermore, these side pieces need not be arranged parallel to one another. For example, the side pieces may extend at an angle to one another.

The alignment of the side pieces should be adapted to the particular purpose for which a hanging device according to the invention is to be used. For example, for a hanging device which is provided as a laundry dryer on a heating unit, space considerations may make it advantageous to align both side pieces parallel to one another. On the other hand, side pieces running at an angle to one another have the advantage that the receiving element has regions of different lengths, thus possibly resulting in better drying of laundry articles or the like.

The laundry articles to be dried or the objects to be hung up may be attached to the cord and/or rod, or simply hung over same.

The width of the hanging device may be adapted to the particular location of use by means of telescoping rods, so that optimal use is made of the space available for the hanging device. The hanging device may be attached, for example, to heating units of different sizes, or also to the wall or to a door or the like.

In one advantageous embodiment of the invention, the side pieces of the swivel element have projections for accepting rods, with the projections preferably having a peg-shaped design. The rods may thus be attached easily and, generally, without additional attachment means, by sliding the rods onto the projections on the side pieces of the swivel element. The projections may also be designed in other shapes such as a tube or an elbow.

One embodiment of the hanging device according to the invention provides that the side pieces of the swivel element have projections on the inner side facing toward a rod and on the outer side facing away from a rod, whereby the outer diameters of the projections on the inner side and on the outer side of a side piece of a swivel element may have different sizes.

In particular for telescoping rods, it is advantageous in this embodiment if the outer diameter of the smaller projections of a side piece of a swivel element when accepting a rod in the form of a telescoping rod is designed to correspond approximately to the inner diameter of the smaller rod of a telescoping rod, or to be slightly smaller than same, and the outer diameter of the larger projections of a side piece of a swivel element when accepting a rod in the form of a telescoping rod is preferably designed to correspond approximately to the inner diameter of the larger rod of a telescoping rod, or to be slightly smaller than same.

When telescoping rods are used, two tubes are usually fitted together one inside the other, with one tube having a smaller outer diameter than the inner diameter of the larger tube. This means that the two ends of such a telescoping rod have different inner diameters, with the result that the projections, which are advantageously designed as pegs, must have different sizes on the side pieces, depending on whether these projections are connected to the smaller or the larger tubes.

If the side pieces have projections having a smaller diameter as well as a larger diameter, the side pieces may be used universally, and it is not necessary to produce different side pieces for the sides of a hanging device according to the invention, thereby saving on production costs.

One advantageous embodiment of the invention thus provides that, for a swivel element having at least two side pieces, the projections with the smaller outer diameter are arranged on the inner side of the one side piece and on the outer side of the other side piece, with the projections with the larger outer diameter preferably being arranged on the inner side of the one side piece and on the outer side of the other side piece. This means that the two side pieces having projections for such a hanging device can be arranged simply in a laterally reversible manner, and that side pieces of identical design can be used.

The use of such side pieces in addition to corresponding base members allows more than only two attachment elements and side pieces to be connected to one another by rods, preferably telescoping rods, thus providing particularly wide and yet stable hanging devices.

Producing the projections by the injection molding process, for example, assures simple and economical production of the projections.

It has proven to be advantageous for the projections to have two parallel indentations at least in their end regions, thus enabling simple production by injection molding, for example.

BRIEF DESCRIPTION OF THE DRAWINGS

The invention will be described in further detail hereinafter with reference to illustrative preferred embodiments shown in the accompanying drawing figures in which.

In the drawings, parts that are identical or that have an identical function are identified by like reference numerals.

DETAILED DESCRIPTION OF PREFERRED EMBODIMENTS

Figure 1:
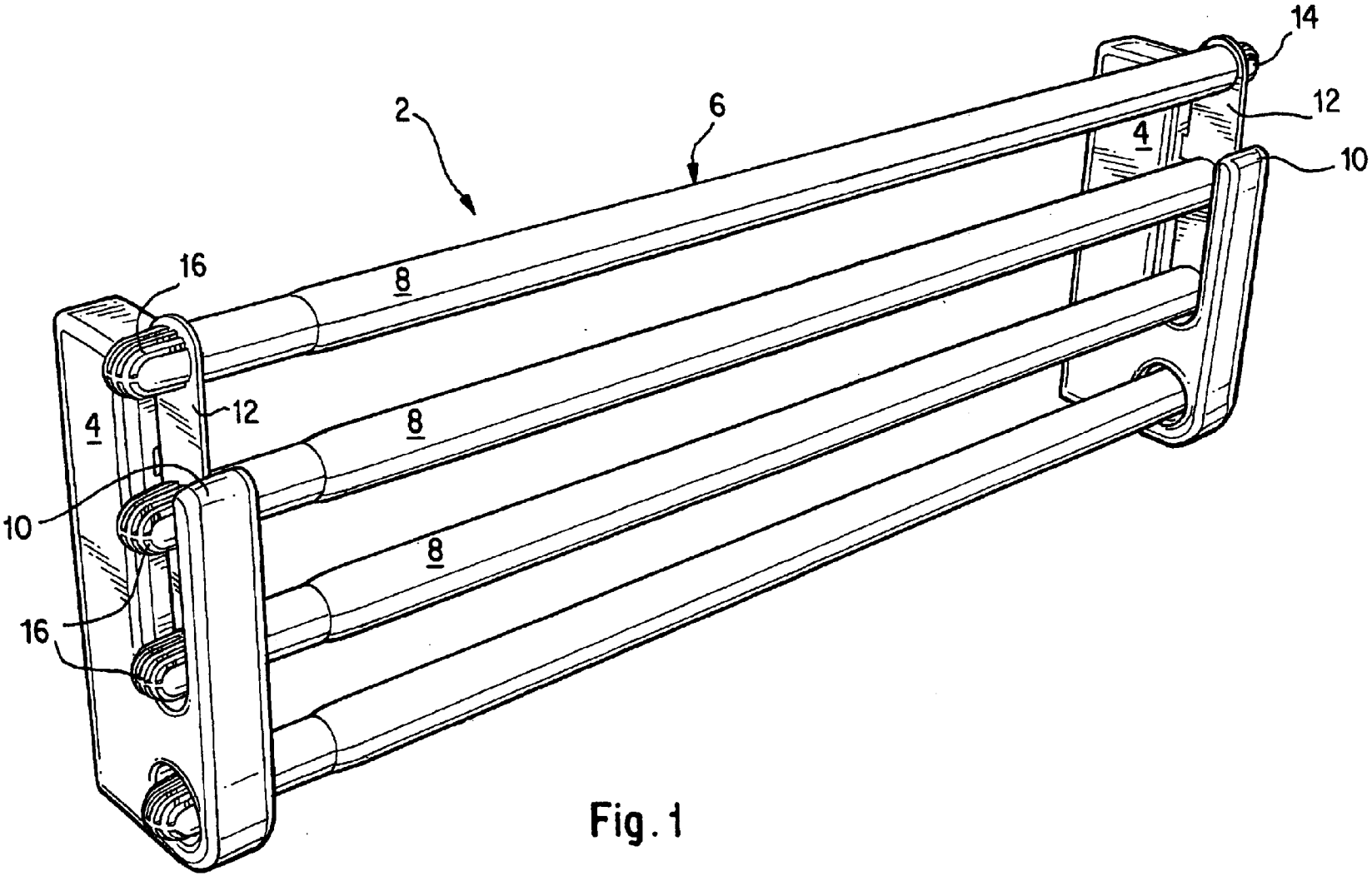
FIG. 1 is a perspective view of a hanging device according to the invention for drying laundry articles, comprising a base member and a swivel element, with the swivel element being swiveled into the base member.

FIG. 1 shows a hanging device 2 provided as a heating unit dryer for drying laundry articles. This hanging device 2 comprises two base members 4 and one swivel element 6 which is connected to the base members 4. Base members 4 are arranged parallel to one another. Swivel element 6 has receiving elements in the form of telescoping rods 8 for receiving laundry articles.

Base members 4 each have a U-shaped design, with the front arm of the U as represented in the drawing being shorter than the rear arm of the U-shaped base member. In the swiveled-together or retracted state of the hanging device shown here, swivel element 6 is situated between each of the two arms of the U-shaped base members 4, so that swivel element 6 is effectively prevented from accidentally falling down or swinging out, without the need for additional parts.

Figure 2:
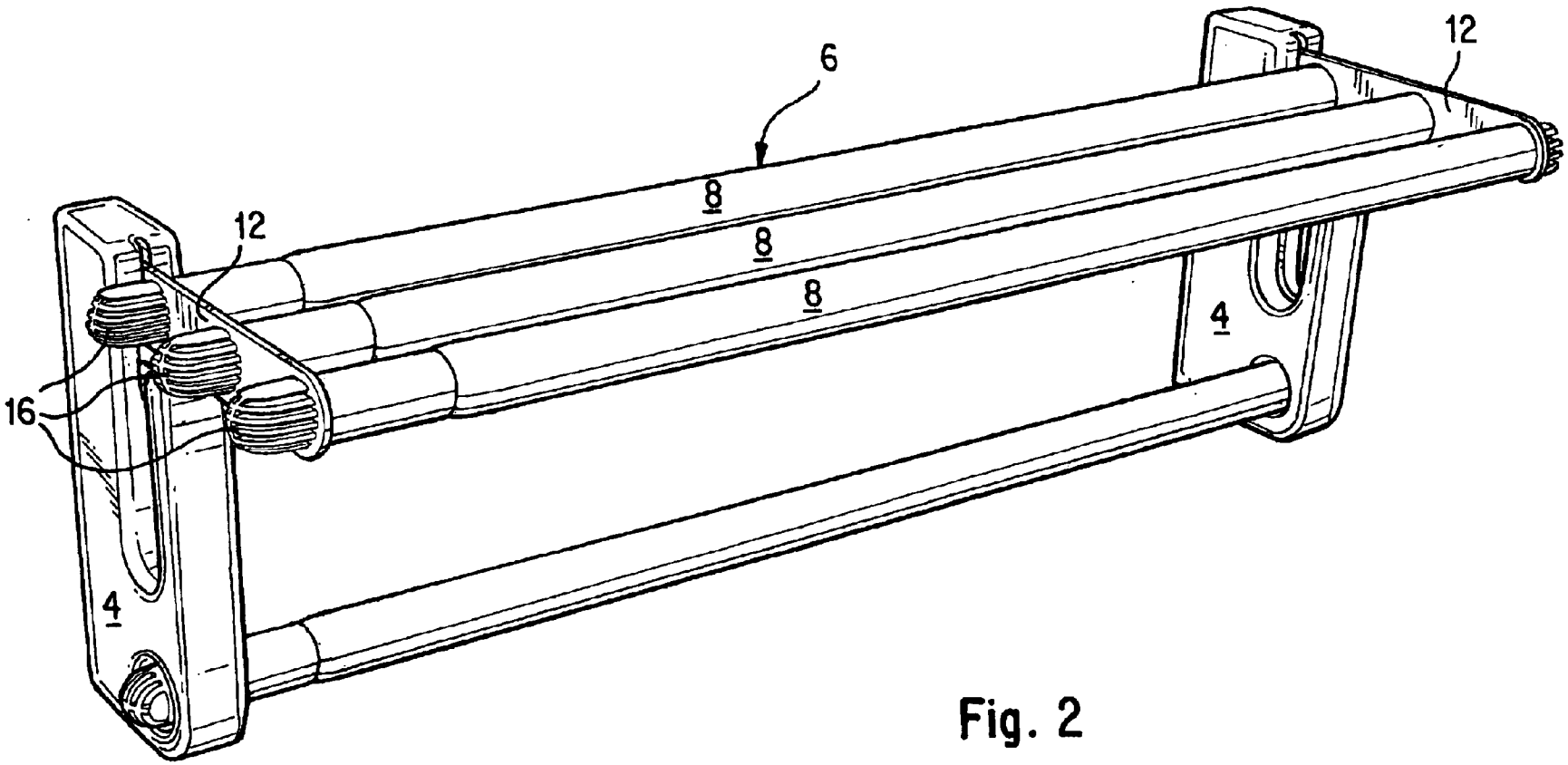
FIG. 2 is a perspective view of the hanging device of FIG. 1 in which the swivel element is swiveled out for use.

FIG. 2 shows the same hanging device as in FIG. 1, except that swivel element 6 is swiveled out or extended in a horizontal position from base members 4 so that telescoping rods 8 provided are capable of receiving laundry articles. In this swiveled-out or extended state swivel element 6 rests on a support surface 10 (FIG. 1) on each of base members 4, with this support surface 10 being formed by the shorter arm of U-shaped base member 4.

In FIGS. 1 and 2, it can be seen that telescoping rods 8 are each formed by two individual rods slid one inside the other.

Each of the rod elements represented on the left side has a smaller inner diameter. These rod elements are attached to peg-shaped projections provided on parallel side pieces 12 of the swivel element. These side pieces also have peg-shaped projections 14, 16 in the regions facing away from telescoping rods 8. Projections 14, 16 have diameters of different sizes, with projections 16 having a larger size than projections 14.

Figure 3:
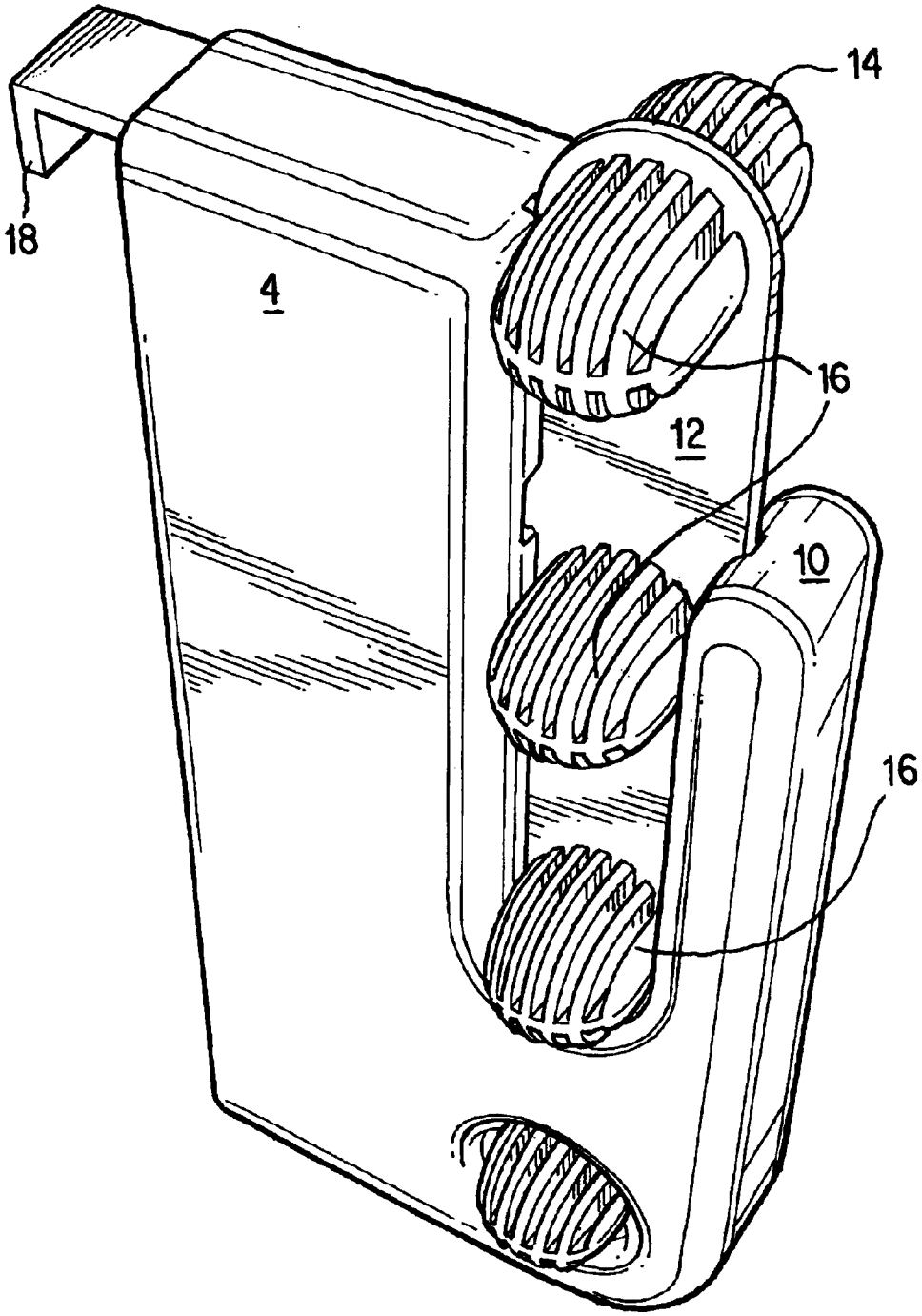
FIG. 3 shows an attachment option for accepting telescoping rods for the drying of laundry articles.

FIG. 3 shows that side pieces 12 have such projections 14, 16 on both sides, with reference being made here to base member 4 shown on the left side in FIGS. 1 and 2. On the right base member 4, side piece 12 is simply attached in a laterally reversed manner, so that projections 14 having the smaller outer diameter are associated with the telescoping rods, not shown in FIG. 3.

Base member 4 in FIG. 3 also has a mounting device 18 for attaching the base members to a heating unit. This mounting element 18 has a hook-shaped design and can therefore be hooked onto a heating unit. The mounting element is also displaceably mounted in the housing of base member 4, so that the particular length of the mounting hook may be adjusted to the width of a corresponding heating unit.

Figure 4:
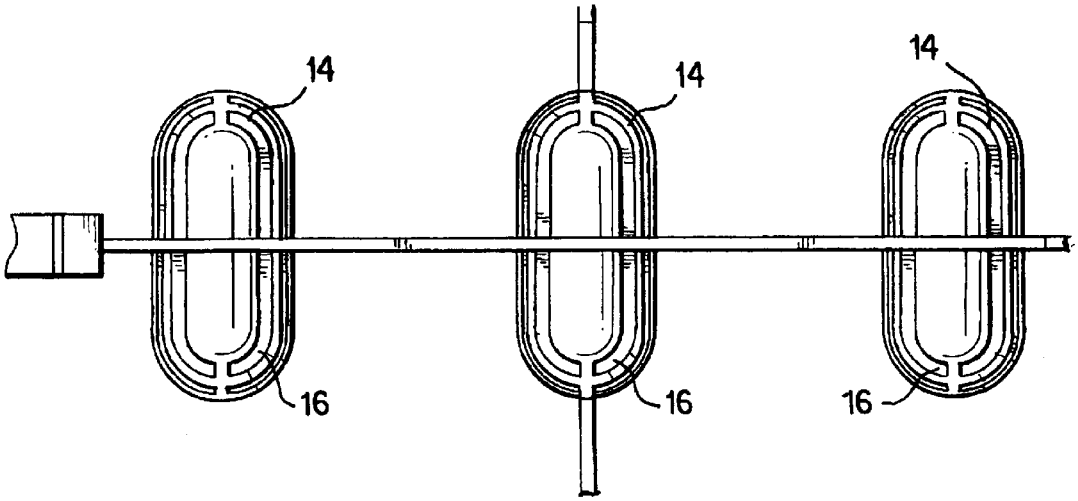
FIG. 4 is a plan view of the attachment device according to FIG. 3.

FIG. 4 shows the different diameters of projections 14 and 16 of side pieces 12. Projections 16 interact with the larger tube sections of telescoping rods 8, while smaller projections 14 interact with the smaller tube sections of telescoping rods 8. Since in the hanging device according to FIGS. 1 and 2 the telescoping rods have a smaller diameter on one end than on the other end, the side pieces having projections 14 and 16 are correspondingly arranged in a laterally reversed manner.

Figure 5A:
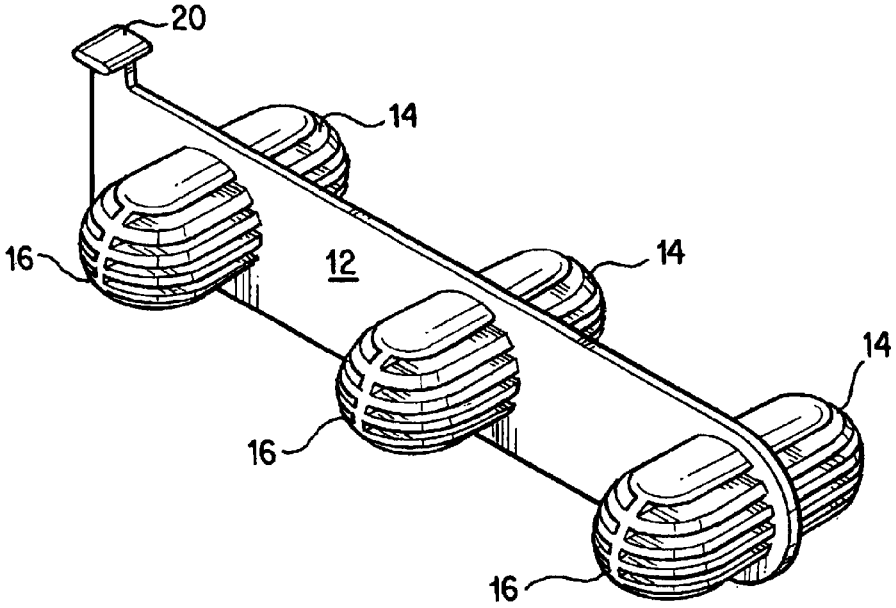
FIGS. 5*a*, 5*b* and 5*c* are perspective views of the attachment device of FIG. 3 with variously configured connecting elements for attaching the swivel element to the base member.
Figure 5B:
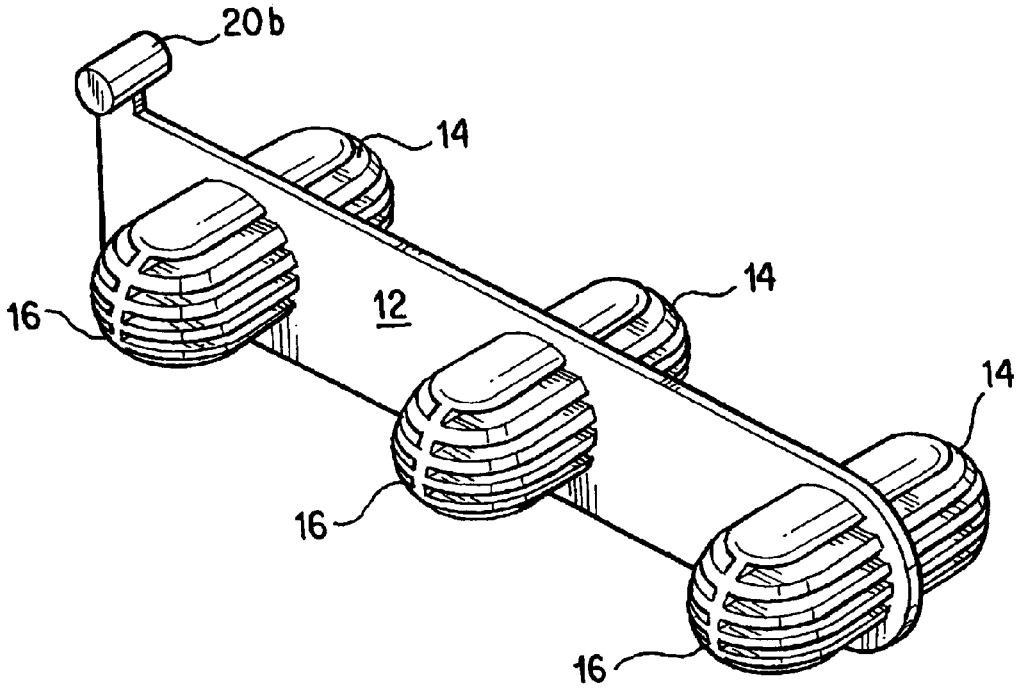
Figure 5C:
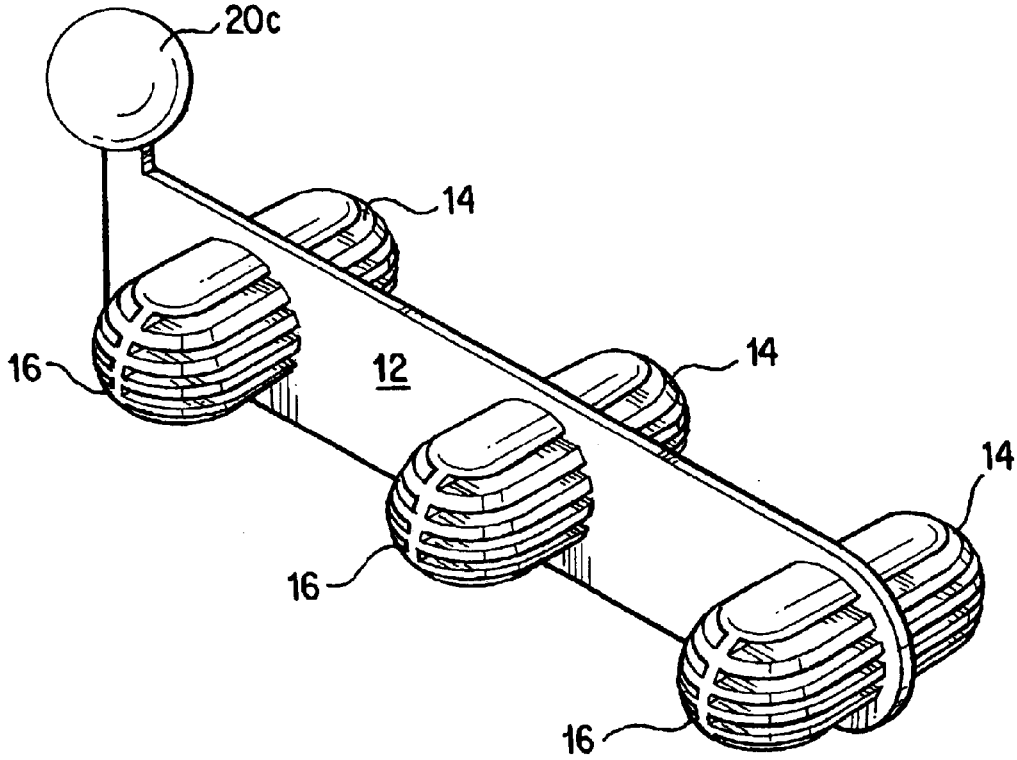
Figure 6:
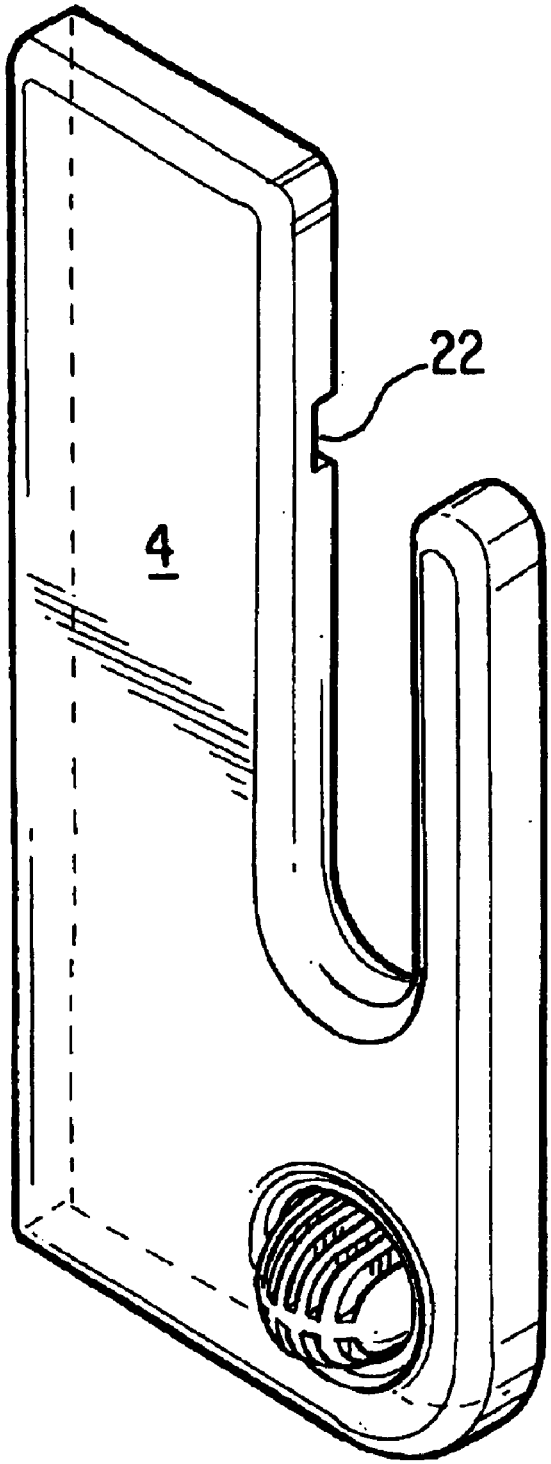
FIG. 6 is a view showing an associated attachment option on the base member for the swivel element of FIG. 5.

FIGS. 5*a*, 5*b* and 5*c* each show a perspective representation of a side piece 12 having three larger projections 16 and three smaller projections 14 which are provided for accepting telescoping rods 8 as previously described. A T-shaped projection 20*a*, a cylindrical projection 20*b* or a spherical projection 20*c* is provided on the end of each side piece 12 which can be engaged in a corresponding recess 22 of base member 4 (FIG. 6). This T-shaped, cylindrical or spherical projection 20*a*, 20*b*, 20*c* is inserted into the corresponding recess 22 of base member 4, thereby holding the swivel element on base member 4 by means of the side pieces. This tongue and groove connection assures that swivel element 6 swings out from base member 4.

It can be seen in FIG. 6 that base member 4 has a two-part housing, with only one half of the housing being shown here.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A hanging device for hanging objects, said device comprising at least one holding device and at least one receiving element for receiving articles to be hung, wherein each holding device comprises at least one base member and one swivel element which is movable between a retracted position in which it is folded adjacent the base member and an extended position in which it is ready for use; the base member has a recess; the swivel element has an attached T-shaped projection which engages in the recess of the base member, and said recess has a shape corresponding to the shape of the projection.

2. A hanging device for hanging objects, said device comprising at least one holding device and at least one receiving element for receiving articles to be hung, wherein each holding device comprises at least one base member and one swivel element which is movable between a retracted position in which it is folded adjacent the base member and an extended position in which it is ready for use; the base member has a recess; the swivel element has an at least partially cylindrically-shaped projection attached thereto which engages in the recess of the base member, and the recess has a shape corresponding to that of the projection.

3. A hanging device for hanging objects, said device comprising at least one holding device and at least one receiving element for receiving articles to be hung, wherein each holding device comprises at least one base member and one swivel element which is movable between a retracted position in which it is folded adjacent the base member and an extended position in which it is ready for use; the base member has a recess; the swivel element has an at least partially spherically-shaped projection attached thereto which engages in the recess of the base member, and the recess has a shape corresponding to the shape of the projection.

4. A hanging device for hanging objects, said device comprising at least one holding device and at least one receiving element for receiving articles to be hung, wherein each holding device comprises at least one base member and one swivel element which is movable between a retracted position in which it is folded adjacent the base member and an extended position in which it is ready for use; the base member has an essentially U-shaped configuration, with the swivel element engaged in one arm of the U-shaped base member, and the other arm of the U-shaped base member supporting the swivel element in the extended, ready-for-use position.

5. A hanging device for hanging objects, said device comprising at least one holding device and at least one receiving element for receiving articles to be hung, wherein each holding device comprises at least one base member and one swivel element which is movable between a retracted position in which it is folded adjacent the base member and an extended position in which it is ready for use; the at least one receiving element comprises at least one telescoping rod extending between and supported by two laterally spaced swivel elements; the laterally spaced swivel elements comprise parallel side pieces, and the side pieces are provided with attached, peg-shaped projections which are received in respective hollow ends of the at least one telescoping rod to support the rods.

6. A hanging device according to claim 5, wherein each side piece of the swivel element has projections on both sides, with the projections on one side the side piece having a larger diameter than the projections on the other side of the side piece.

7. A hanging device according to claim 6, wherein each telescoping rod comprises a hollow outer tube and a hollow inner tube; the diameter of the larger diameter projections corresponds substantially to an inner diameter of the hollow outer tube of the telescoping rod, and diameter of the projections on the other side of the side piece corresponds substantially to an inner diameter of the hollow inner tube of the telescoping rod.

8. A hanging device according to claim 6, wherein the projections are injection molded members.

9. A hanging device according to claim 5, wherein the projections are provided with surface recesses for facilitating compression of the projection upon insertion into a hollow end of a telescoping rod.

* * * * *